US007237283B2

(12) United States Patent
Devries

(10) Patent No.: US 7,237,283 B2
(45) Date of Patent: Jul. 3, 2007

(54) LAY-DOWN STYLE HUNTING BLIND

(76) Inventor: John A. Devries, 423 3rd Ave., Enderlin, ND (US) 58027

( * ) Notice: Subject to any disclaimer, the term of this patent is extended or adjusted under 35 U.S.C. 154(b) by 486 days.

(21) Appl. No.: 10/663,919

(22) Filed: Sep. 16, 2003

(65) Prior Publication Data

US 2005/0055894 A1 Mar. 17, 2005

(51) Int. Cl.
*A01M 31/00* (2006.01)
*A47G 9/06* (2006.01)
*A47G 9/08* (2006.01)

(52) U.S. Cl. ..... 5/419; 5/413 AM; 5/505.1; 43/1; 135/901

(58) Field of Classification Search ..... 135/901; 43/1; 5/419, 420, 413 AM, 505.1
See application file for complete search history.

(56) References Cited

U.S. PATENT DOCUMENTS 598,995 A * 2/1898 Jacob ..... 5/413 R
867,464 A * 10/1907 Abbott ..... 5/413 R
1,577,825 A * 3/1926 Jenness ..... 5/648
2,555,051 A * 5/1951 Miller ..... 5/413 R
4,329,747 A * 5/1982 Russell ..... 5/420
4,751,936 A * 6/1988 Zibble et al. ..... 135/117
4,757,832 A * 7/1988 Russell ..... 135/128
4,862,533 A * 9/1989 Adams, III ..... 5/413 R
5,203,042 A * 4/1993 Mason ..... 5/504.1
5,528,779 A * 6/1996 Lee et al. ..... 5/413 AM
5,690,134 A * 11/1997 McCauley ..... 135/133
D405,890 S * 2/1999 Latschaw ..... D25/16
6,694,995 B1 * 2/2004 Ransom ..... 135/128
6,698,131 B2 * 3/2004 Latschaw ..... 43/1
6,799,339 B2 * 10/2004 Stewart ..... 5/413 AM
6,895,614 B1 * 5/2005 Peck ..... 5/419
6,952,845 B1 * 10/2005 Akkad ..... 5/419
2003/0204908 A1 * 11/2003 Figler ..... 5/413 AM
2003/0229942 A1 * 12/2003 Dilascio ..... 5/505.1
2004/0000084 A1 * 1/2004 Latschaw ..... 43/1
2004/0216238 A1 * 11/2004 Stewart et al. ..... 5/722
2004/0231221 A1 * 11/2004 Latschaw ..... 43/1

* cited by examiner

*Primary Examiner*—Robert Canfield
(74) *Attorney, Agent, or Firm*—Gerald E. Helget; Nelson R. Capes; Briggs and Morgan, P.A.

(57) ABSTRACT

A frameless, portable, layout hunting blind for use by a sitting or reclining hunter has a frameless floor, an enclosed foot and leg sack for the hunter's legs, a movable flap to cover the hunter's upper body, a collapsible foot sack support to keep the foot sack clear of the hunter's legs, and an air-inflatable head and shoulder rest.

18 Claims, 3 Drawing Sheets

LAY-DOWN STYLE HUNTING BLIND

BACKGROUND OF THE INVENTION

Success in the sport of hunting is usually increased by the use of a hunting blind to help shield the hunter from view of the prey. Hunting blinds may be permanent or portable. Permanent hunting blinds typically include a rigid-wall, box-like structure mountable on legs for elevating the hunter above the ground and for protecting the hunter within the box from view of the prey. Ground-level hunting blinds are utilized for the hunter to sit, crouch, or stand behind or in. Pit blinds are also used. Portable hunting blinds are sometimes advantageous as they may be easily carried by a single hunter and set up at various locations throughout the day. Moreover, a portable hunting blind may be moved easily to change the position of the hunting blind with respect to the direction of view of the hunter.

Layout or laydown hunting blinds allow the hunter to sit or recline on the ground inconspicuously in a field while a large portion of his body is covered by the blind. Typically, the hunter has a loaded weapon within the blind, and the blind includes some sort of quickly releasable cover or door that allows the hunter to sit up and aim the weapon at prey very rapidly.

In the past, layout hunting blinds have required some sort of metal framework to keep the blind off the hunter's body while the hunter is reclining within the blind. Such frameworks have added weight and bulk to the blind, reducing its portability. Furthermore, earlier layout hunting blinds have been uncomfortable with poor head support and have not included an air-inflatable headrest. In addition, earlier layout blinds have been uncomfortable with poor head support and with rigid frames generally required flat ground for use.

There is a need for a portable, layout hunting blind that minimizes the supporting framework and provides an air-inflatable head and shoulder rest for the hunter. The blind should not have a rigid frame, and should therefore be usable whether or not the ground upon which it will rest is flat.

SUMMARY OF THE INVENTION

A portable, layout hunting blind for use by a sitting or reclining hunter has a frameless floor, (i.e., the floor lacks a frame) an enclosed foot and leg sack for the hunter's legs, a movable flap to cover the hunter's upper body, a collapsible foot sack support to keep the foot sack clear of the hunter's legs, and an air-inflatable head and shoulder rest.

A principle object and advantage of the present invention is that there is no rigid frame supporting the floor side walls and top of the blind. There are thus no metal bars to bend, break, or create discomfort.

Another principle object and advantage of the present invention is that because the floor is frameless and flexible, it can be used on flat or rough ground and easily rolls up rather than folds or otherwise breaks down.

Another principle object and advantage of the present invention is that it includes an air-inflatable head and shoulder rest that is adjustable and thereby comfortable, which also works as support for sides.

DETAILED DESCRIPTION OF THE PREFERRED EMBODIMENT

Figure 2:
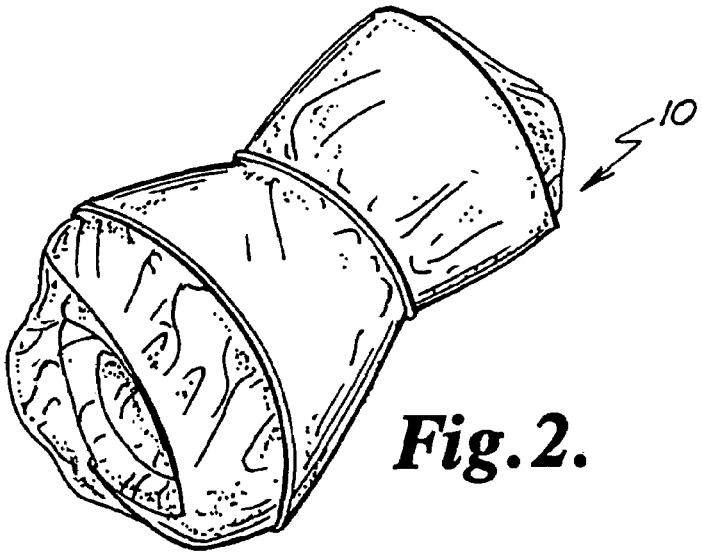
FIG. 2 is a perspective view of the present invention in a rolled-up configuration.
Figure 1:
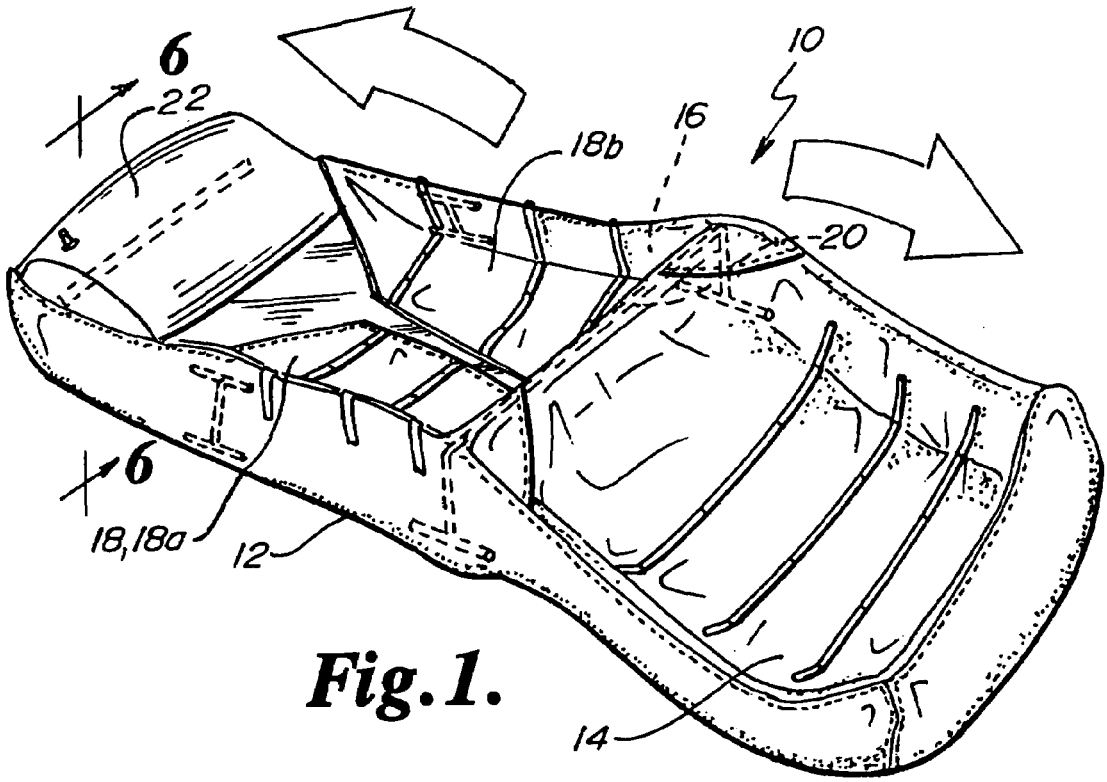
FIG. 1 is a perspective view of the present invention in a deployed position with some internal structure shown in phantom.

The frameless, portable, layout hunting blind of the present invention is generally shown in the Figures as reference numeral 10.

The hunting blind 10 further comprises a frameless floor 12; an enclosed foot sack 14 having an opening 16 adapted to receive the hunter's legs; a movable flap 18 attached to the floor 12 and adapted to cover the hunter's body; a collapsible foot sack support 20 attached to the foot sack opening 16 and adapted to keep the foot sack opening 16 clear of the hunter's legs; and air-inflatable head and/or shoulder rest 22.

In one embodiment, the movable flap 18 further comprises two flaps 18*a* and 18*b*.

In one embodiment, the collapsible foot sack support 20 further comprises a substantially horizontal first bar 20*a* attached to the foot sack opening 16, a vertical second bar 20*b* attached to the substantially horizontal first bar 20*a*, and a substantially horizontal foot 20*c* attached to the vertical second bar 20*b* and engaging the floor 12.

In one embodiment, the collapsible foot sack support 20 pivots about the foot sack opening 16 to a position that supports the footsack opening 16 clear of the hunter's legs to a position (shown in phantom in FIG. 5) in which the footsack opening 16 may be collapsed for storage and transport of the hunting blind 10.

Figure 5:
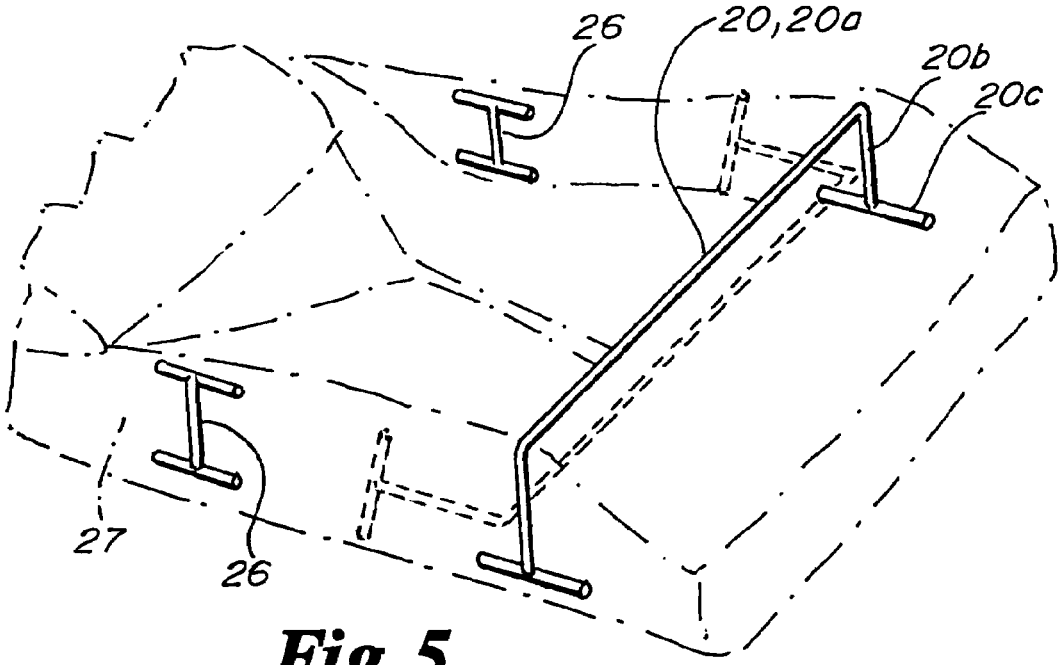
FIG. 5 is a perspective view of the present invention showing internal structure.

In FIG. 5, the phantom lines of the foot sack support 20 show the foot sack support in the down position, lying on the floor, and in the up position that keeps the foot sack opening clear for the hunter's feet.

In one embodiment, the first bar 20*a*, second bar 20*b*, and foot 20*c* are a single piece.

In one embodiment, the air-inflatable head rest 22 is removably attached to the floor 12, as for example by hook and loop material 23. This allows the head rest 22 to be completely removed from the blind if desired, as for example, for cleaning.

In one embodiment, the hunting blind 10 further comprises a cushion 24 positionable on the floor 12. In one embodiment, the cushion 24 is removable from the hunting blind 10.

The hunting blind 10 may optionally have side supports 26 that keep the sides 27 of the floor 12 upright around the hunter's body.

Figure 3:
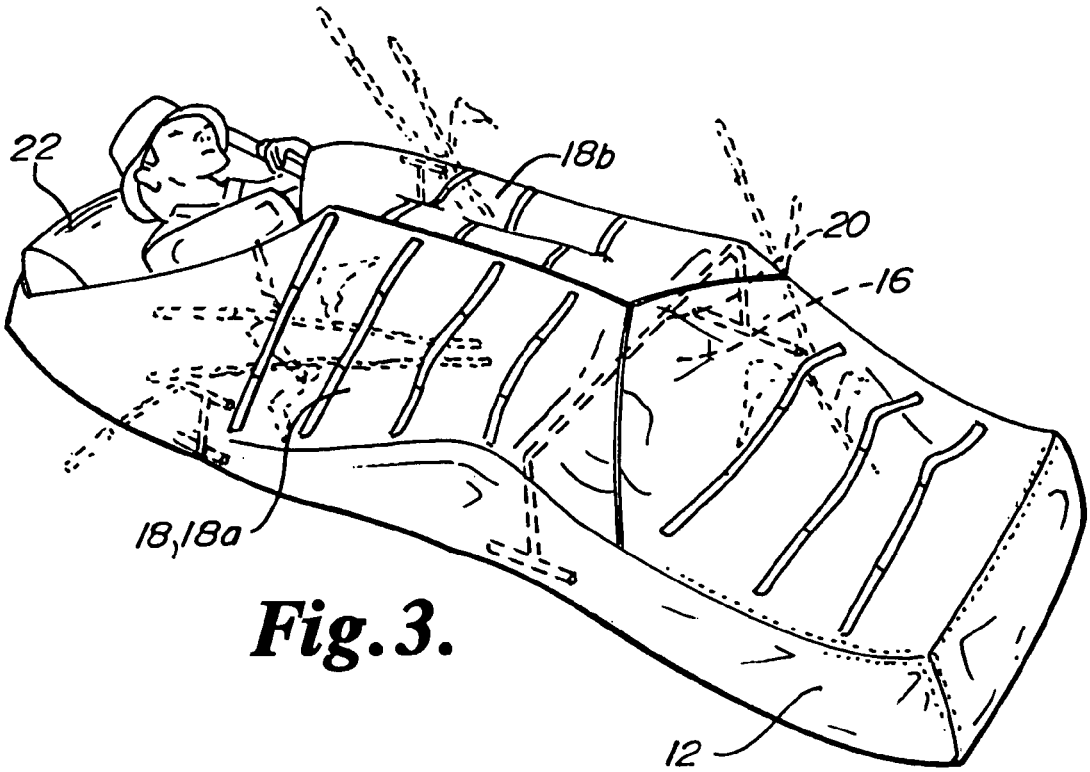
FIG. 3 is similar to FIG. 2, but shows a hunter enclosed in the hunting blind.
Figure 4:
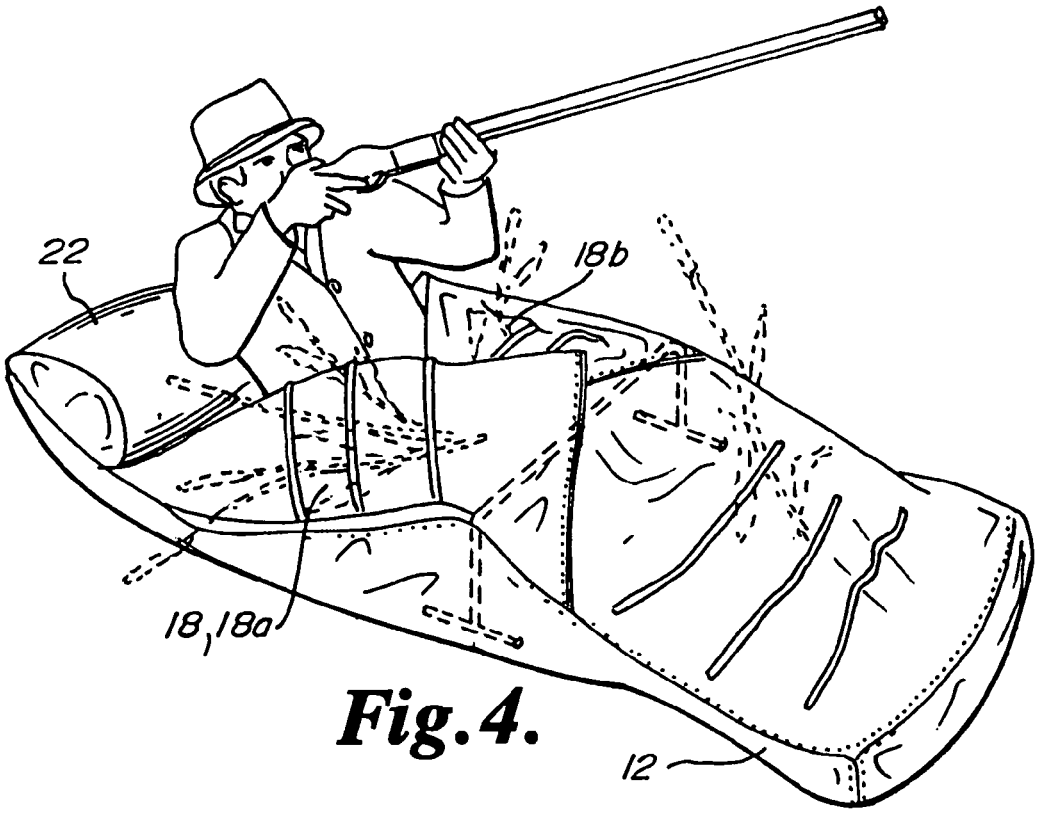
FIG. 4 is similar to FIG. 3, but shows the hunter sitting in the hunting blind in a ready to shoot position.
Figure 6:
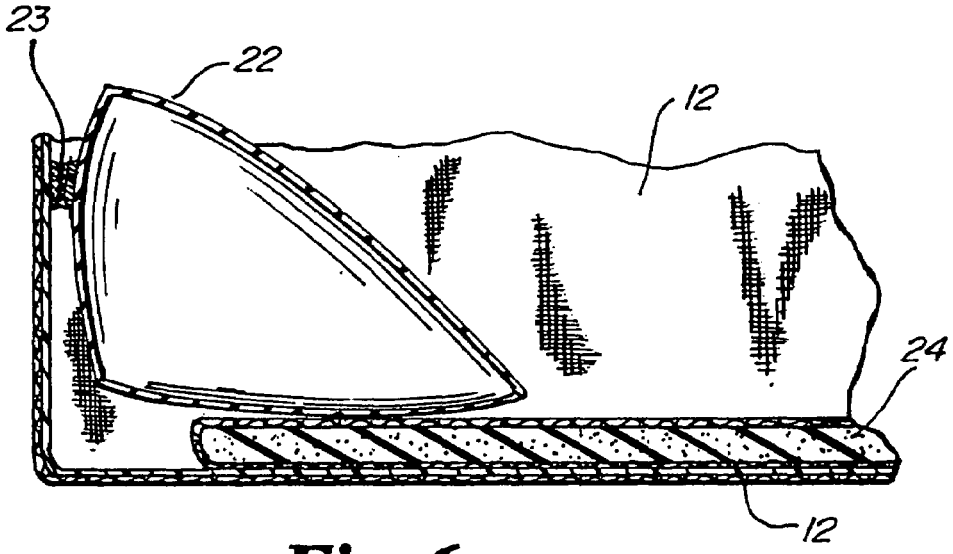
FIG. 6 is a cross-section of the present invention showing internal structure.

In use, the hunter enters the layout blind by sliding his legs into the foot sack opening 16, lying down, and covering his body with the flap 18, as shown in FIG. 3. When the hunter desires to shoot prey, he raises the flap 18, sits up, and lifts his firearm to a shooting position, as shown in FIG. 4.

When the hunter desires to store or transport the hunting blind, the hunting blind 10 can be conveniently rolled up and tied as shown in FIG. 2.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A portable, layout flexible hunting blind with minimal supporting framework adapted to enclose a sitting or reclining hunter, the hunting blind comprising:

(a) a frameless floor;

(b) an enclosed foot sack having an opening adapted to receive the hunter's legs;

(c) a movable flap attached to the floor and adapted to cover the hunter's body;

(d) a collapsible foot sack support attached to the foot sack opening and adapted to keep the foot sack opening clear of the hunter's legs; and (e) an air-inflatable head rest.

2. The hunting blind of claim 1, wherein the collapsible foot sack support further comprises a substantially horizontal first bar attached to the foot sack opening, a vertical second bar attached to the substantially horizontal first bar, and a substantially horizontal foot attached to the vertical second bar and engaging the floor.

3. The hunting blind of claim 2, wherein the first bar, second bar, and foot are a single piece.

4. The hunting blind of claim 1, wherein the air-inflatable headrest is removably attached to the floor.

5. The hunting blind of claim 1, further comprising a cushion positionable on the floor.

6. The hunting blind of claim 5, wherein the cushion is removable from the hunting blind.

7. A portable, layout flexible hunting blind with minimal supporting framework adapted to enclose a sitting or reclining hunter, the hunting blind comprising:

(a) a frameless floor;

(b) an enclosed foot sack having an opening adapted to receive the hunter's legs;

(c) a movable flap attached to the floor and adapted to cover the hunter's body;

(d) a collapsible foot sack support attached to the foot sack opening and adapted to keep the foot sack opening clear of the hunter's legs; and (e) an air-inflatable head and shoulder rest, wherein the air-inflatable headrest is removably attached to the floor.

8. The hunting blind of claim 7, wherein the collapsible foot sack support further comprises a substantially horizontal first bar attached to the foot sack opening, a vertical second bar attached to the substantially horizontal first bar, and a substantially horizontal foot attached to the vertical second bar and engaging the floor.

9. The hunting blind of claim 8, wherein the first bar, second bar, and foot are a single piece.

10. The hunting blind of claim 7, further comprising a cushion positionable on the floor.

11. The hunting blind of claim 10, wherein the cushion is removable from the hunting blind.

12. A portable, layout flexible hunting blind with minimal supporting framework adapted to enclose a sitting or reclining hunter, the hunting blind comprising:

(a) a frameless floor;

(b) an enclosed foot sack having an opening adapted to receive the hunter's legs;

(c) a movable flap attached to the floor and adapted to cover the hunter's body;

(d) a collapsible foot sack support attached to the foot sack opening and adapted to keep the foot sack opening clear of the hunter's legs;

(e) an air-inflatable head rest, wherein the air-inflatable headrest is removably attached to the floor; and (f) a cushion positionable on the floor.

13. The hunting blind of claim 12, wherein the collapsible foot sack support further comprises a substantially horizontal first bar attached to the foot sack opening, a vertical second bar attached to the substantially horizontal first bar, and a substantially horizontal foot attached to the vertical second bar and engaging the floor.

14. The hunting blind of claim 13, wherein the first bar, second bar, and foot are a single piece.

15. The hunting blind of claim 12, wherein the cushion is removable from the hunting blind.

16. The hunting blind of claim 12, further comprising side supports for the floor.

17. The hunting blind of claim 12, wherein the collapsible foot sack support pivots about the foot sack opening.

18. The hunting blind of claim 1, wherein the movable flap further comprises two flaps that meet to cover the hunter's body.

* * * * *